United States Patent [19]

Iijima et al.

[11] Patent Number: 5,018,430

[45] Date of Patent: May 28, 1991

[54] ELECTRONIC MUSICAL INSTRUMENT WITH A TOUCH RESPONSE FUNCTION

[75] Inventors: Tatsuya Iijima, Fussa; Hiroshi Morokuma, Akishima, both of Japan

[73] Assignee: Casio Computer Co., Ltd., Tokyo, Japan

[21] Appl. No.: 366,733

[22] Filed: Jun. 15, 1989

[30] Foreign Application Priority Data

Jun. 22, 1988 [JP] Japan ..... 63-81718[U]
Jun. 22, 1988 [JP] Japan ..... 63-81719[U]

[51] Int. Cl.[5] ..... G10H 1/057; G10H 1/08; G10H 1/46; G10H 7/02

[52] U.S. Cl. ..... 84/625; 84/627; 84/633

[58] Field of Search ..... 84/622-633, 84/659-665, 692-711, 735-741, 687-690

[56] References Cited

U.S. PATENT DOCUMENTS 4,674,382 6/1987 Yorihisa ..... 84/626
4,875,400 10/1989 Okuda et al. ..... 84/626

*Primary Examiner*—Stanley J. Witkowski
*Attorney, Agent, or Firm*—Frishauf, Holtz, Goodman & Woodward

[57] ABSTRACT

Initial touch data or after touch data is obtained by operating a play input unit, such as keys or strings. A musical tone whose timbre or volume changes by the touch data is obtained. A tone generator has a plurality of sound source lines. Desired waveform data is selected by the touch data for each line. Only one type of the selected waveform data that is segmented at a touch split point is outputted for each line. The musical tone may be detuned by finely staggering the reference frequency, for each line. An envelope waveform may be applied to the musical tone for each line.

15 Claims, 10 Drawing Sheets

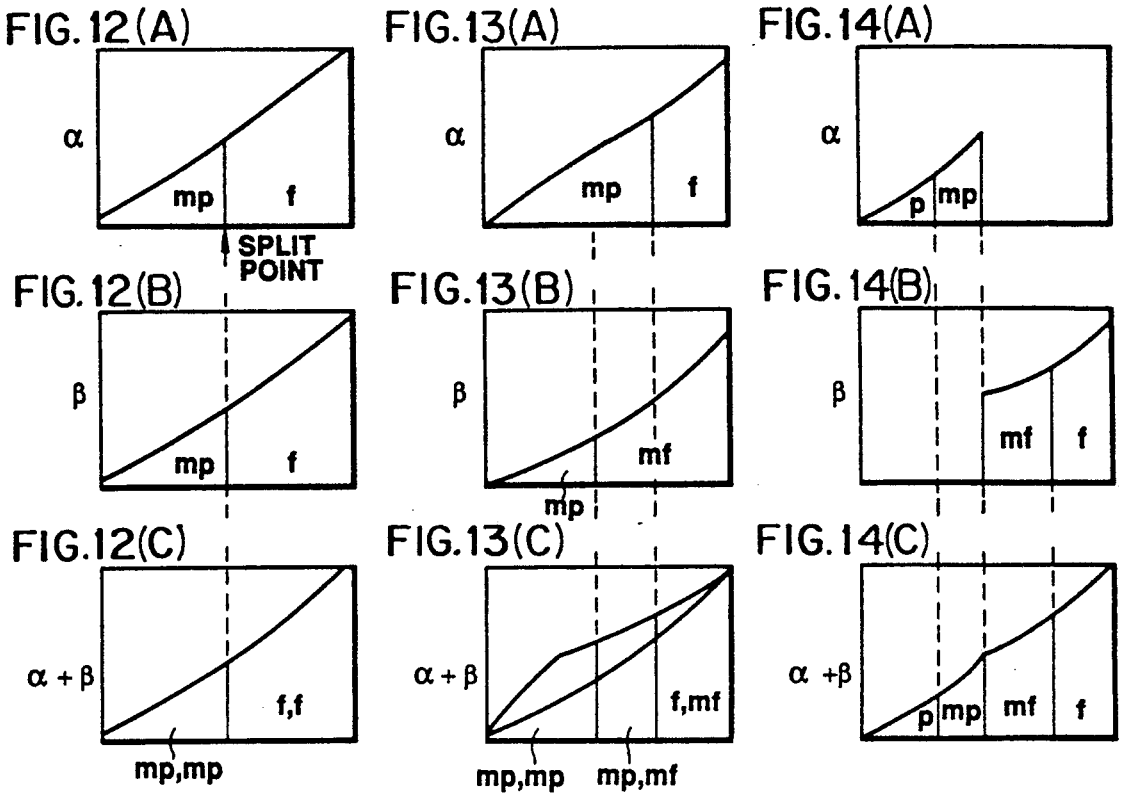
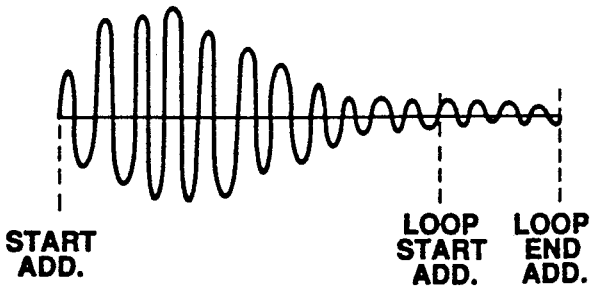
FIG. 15

ELECTRONIC MUSICAL INSTRUMENT WITH A TOUCH RESPONSE FUNCTION

BACKGROUND OF THE INVENTION

1. Field of the Invention

The present invention relates to an electronic musical instrument with a touch response function which is capable of varying a volume and a timbre of a musical tone in accordance with initial or after touch data representing a velocity and/or a pressure of an operated play input, such as keys, strings and blowing.

2. Description of the Related Art

There has been an electronic musical instrument of the type in which the touch data entered is compared with a prefixed touch split point or a touch split point set by a player, and a waveform (fundamental waveform) of a musical tone is set up on the basis of the result of the comparison (see FIG. 1). For example, when the entered touch data is larger than the preset touch split point, a waveform sampled for large touch data (referred to as a strong-touch tone waveform) is selected for the tone waveform. A volume of the tone is based on the touch data. Incidentally, a waveform sampled when the touch data is smaller than the touch split point is called a weak-touch tone waveform. A typical example of the musical instrument of this type is disclosed in U.S. patent application No. 760,290, filed on July 29, 1985, and issued as U.S. Pat. No. 4,681,008. The approach of the touch data-touch split point comparison shown in FIG. 1 can readily make the function to vary a timber of a tone in accordance with the touch data. When the musical instrument designed on the basis of the above approach is continuously played using the touch data in the vicinity of the touch split point, a timber of a tone rapidly varies. The rapidly varying timbre makes listeners feel unnaturally.

To cope with the unnatural feeling, there is proposed another approach, called a velocity cross fade, in which a ratio of the strong-touch tone waveform and the weak-touch tone waveform that are to be mixed is gradually changed in the vicinity of a waveform change point. A typical example of the musical instrument designed based on this approach is DIGITAL WAVE FILTERING SAMPLER TX16W manufactured by Yamaha Co. The musical instrument employs two sound source lines. The strong-touch tone waveform and the weak-touch tone waveform are respectively assigned to the sound source lines. When the touch data is small, viz., a velocity of a play input is slow, one of the sound source lines provides a musical tone with a timbre based on the weak-touch tone waveform configured by a $\beta$ touch curve (see FIG. 2). When the touch data becomes large, the other sound source line provides a musical tone with a timbre based on the strong-touch tone waveform configured by an $\alpha$ touch curve. In the velocity fade interval, a tone with a timbre based on the weak-touch tone waveform is mixed with a tone with a timbre based on the strong-touch tone waveform in a cross fade mode, and is sounded. A mixing ratio of those waveforms is varied for musical tone formation. This approach indeed succeeded in solving the unnatural feeling problem due to a rapid variation of the timbre. However, the approach involves another problem when a tone is detuned by staggering the frequencies of the tones of the sound source lines, with an intention to give the tone beats and something deep. The detune is effective only in the cross fade interval where the sound source lines concurrently provide the tone waveforms of different frequencies. As a whole, the detune effect is indistinctive.

An additional approach to vary the volume and the timbre of a tone in accordance with the touch data has been known. Electronic musical instruments implementing the approach is disclosed in U.S. patent application No. 199,166, filed on May 26, 1988, and issued as U.S. Pat. No. 4,875,400. The musical instrument is configured as shown in FIG. 3. In the figure, a sinusoidal waveform as a fundamental waveform of a tone is read from a waveform memory 1. On the basis of the sinusoidal waveform data, four lines individually produce four sinusoidal wave signals 2-1 to 2-4 of different pitches which are related to one another in an overtone fashion, for example. Touch controllers 3-1 to 3-4 touch controls o level controls the sinusoidal wave signals 2-1 to 2-4 by using different touch response data (touch curve) defining the relation of the touch data and the sounding level. The sinusoidal wave signals of four lines that are level controlled in accordance with the touch response data, are added together by an adder 4, thereby to form a composite musical tone waveform. The composite waveform is applied to an envelope controller 5. Controller 5 varies the composite waveform with respect to time in accordance with an envelope supplied from an envelope generator (not shown), resulting in a musical tone.

In this type of the electronic musical instrument, it is only the same tone waveform that can be set to the four lines. Therefore, even if the different touch controls are applied to the four lines, it is impossible to obtain such a musical tone that is generated only when a play input of a strong touch, for example, occurs. A variation in a timbre of the resultant tone is poor.

SUMMARY OF THE INVENTION

Accordingly, an object of the present invention is to provide an electronic musical instrument capable of smoothly shifting a timbre of tone to another timbre of tone in accordance with touch data, and effectively applying the detune to a tone.

Another object of the present invention is to provide an electronic musical instrument capable of greatly and smoothly change a timbre of tone to another timbre of tone in accordance with the touch data, and consequently producing natural musical tones in a broad range from weak tones to strong tones.

According to one aspect of the present invention, there is provided an electronic musical instrument comprising waveform generating means having a plurality of lines each including a plurality of tone waveforms assigned thereto, the plurality of lines being selected for one item of pitch data, the waveform generating means generating one of the plurality of tone waveforms for the each line, touch response data setting means for setting for the each line touch response data representing a relationship between touch data and a signal level, touch split point setting means for setting for the each line a point to divide the touch response data into a plurality of corresponding areas, waveform assigning means for assigning the plurality of tone waveforms for the each area as is set by the touch split point setting means, the waveform assigning means being coupled with the waveform generating means, determining means for determining which of the areas of the touch response data corresponds to the touch data, waveform select means for selecting for the each line the musical tone waveform that is assigned to the area determined by the determining means, modulating means for modulating a plurality of tone waveforms selected by the waveform selecting means for the each line in response to each touch response data corresponding to the touch data, and detune setting means for staggering the frequencies of the waveforms generated from the plurality of lines.

According to another aspect of the present invention, there is provided an electronic musical instrument comprising waveform generating means having a plurality of lines each including a plurality of tone waveforms assigned thereto, the plurality of lines being selected for one item of pitch data, the waveform generating means generating one of the plurality of tone waveforms for the each line, touch response data setting means for setting for the each line touch response data representing a relationship between touch data and a signal level, touch split point setting means for setting for the each line point to divide the touch response data into a plurality of areas, waveform assigning means for assigning the plurality of tone waveforms for the each area as is set by the touch split point setting means, the waveform assigning means being coupled with the waveform generating means, determining means for determining which of the areas of the touch response data corresponds to the touch data, waveform select means for selecting for the each line the musical tone waveform that is assigned to the area determined by the determining means, modulating means for modulating a plurality of tone waveforms selected by the waveform selecting means for the each line in response to each touch response data corresponding to the touch data, envelope control means for controlling envelope of the tone waveforms of the lines derived from the modulating means, and combining means for combining a plurality of musical tone waveforms obtained by the envelope control means.

BRIEF DESCRIPTION OF THE DRAWINGS

FIGS. 12A through 14C show graphical representations of waveforms of different touch data;

FIG. 15 shows an example of PCM waveforms stored in a tone waveform memory of the instrument of FIG. 10;

DETAILED DESCRIPTION OF THE PREFERRED EMBODIMENTS

1st Embodiment

A first embodiment of an electrical musical instrument according to the present invention will be described with reference to FIGS. 6 to 9.

Figure 1:
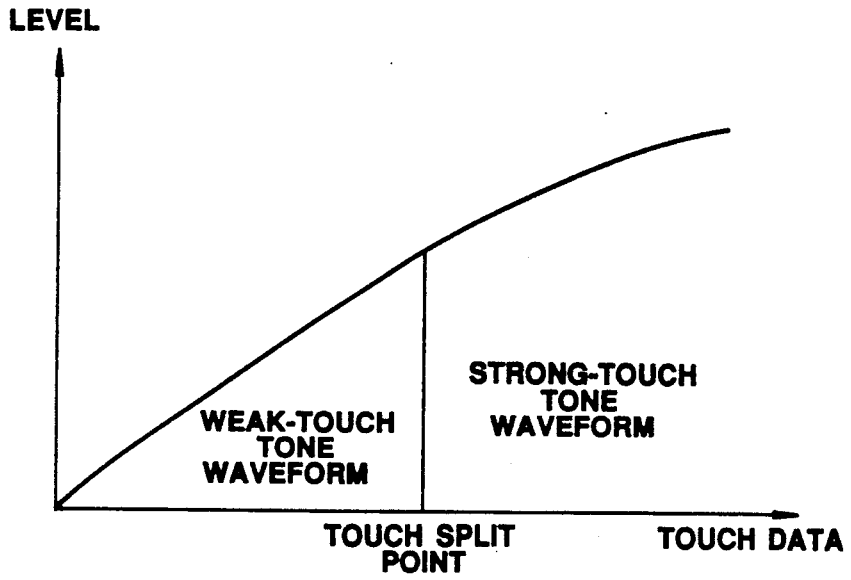
FIG. 1 (PRIOR ART)
FIG. 1 shows a graphical representation of a waveform characteristic of a conventional musical instrument in connection with touch split point.
Figure 2:
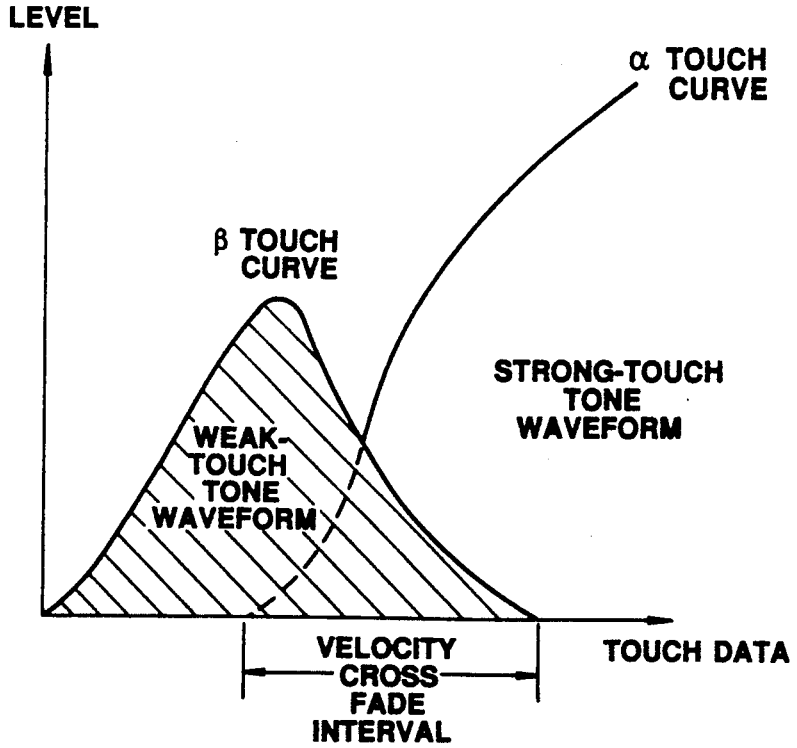
FIG. 2 (PRIOR ART)
FIG. 2 shows a graphical representation of a waveform characteristic of a conventional musical instrument in connection with a velocity cross fade interval.
Figure 3:
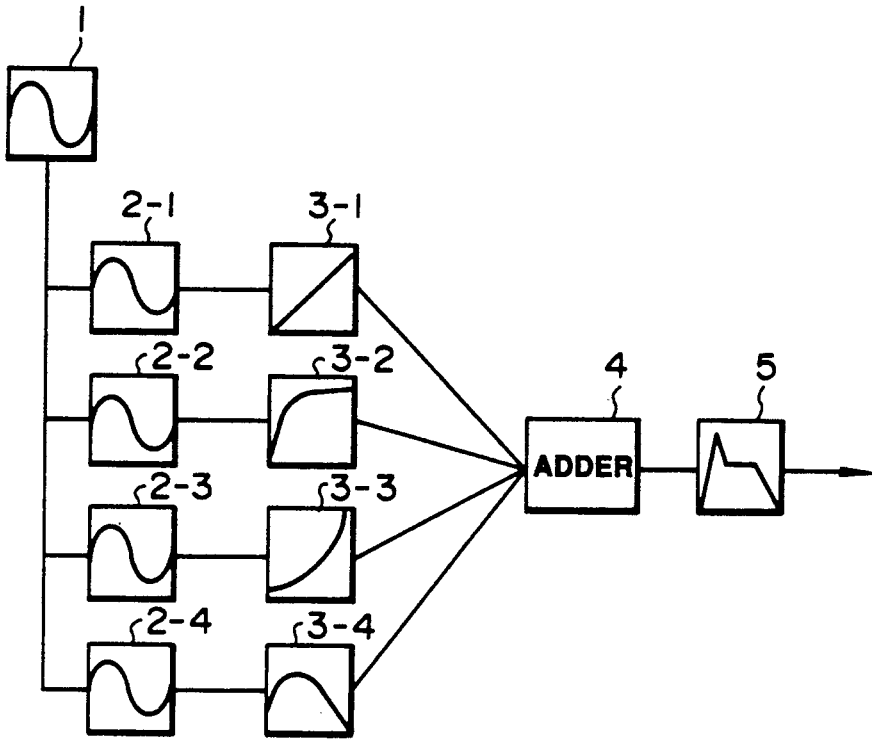
FIG. 3 (PRIOR ART)
FIG. 3 is a block diagram of a conventional musical instrument.
Figure 4:
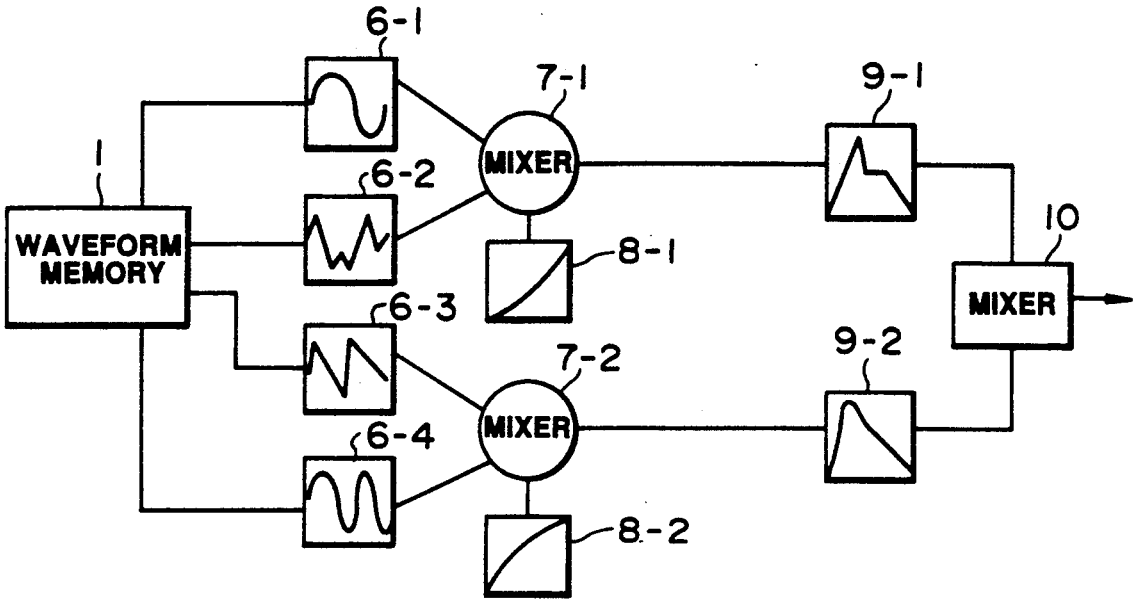
FIG. 4 (PRIOR ART)
FIG. 4 is a block diagram of another conventional musical instrument of the type in which two sound source lines are combined to form a desired musical tone.
Figure 5:
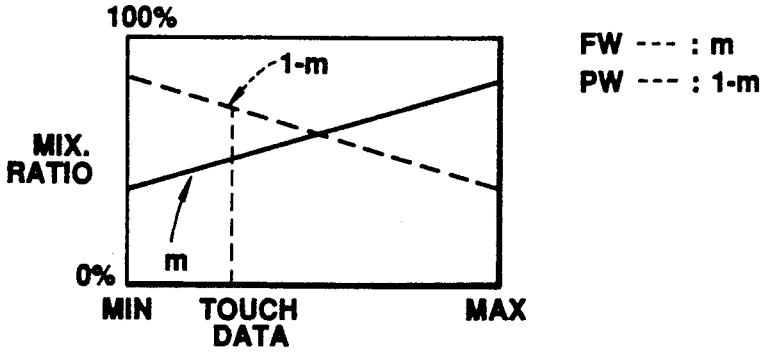
FIG. 5 (PRIOR ART)
FIG. 5 is a graph showing the relationship of the mixing ratios for FW and PW waveforms and the touch data that are used in the instrument of FIG. 4.
Figure 6:
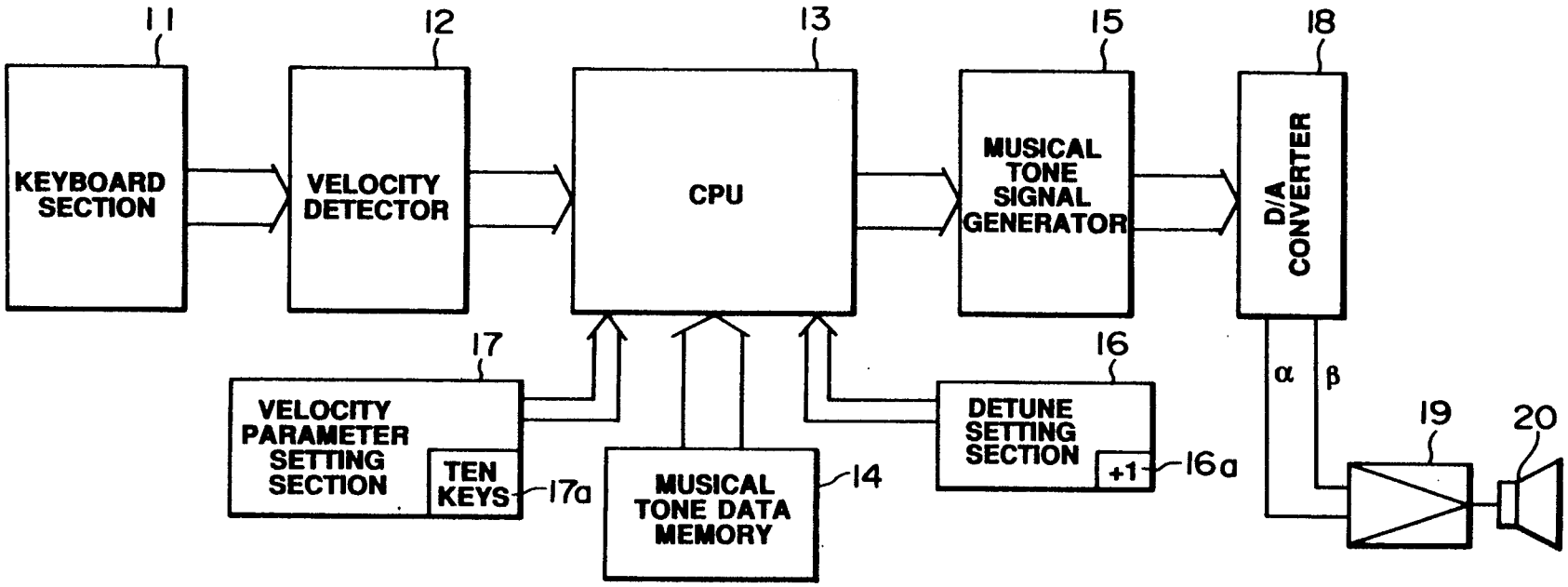
FIG. 6 is a block diagram of an electronic musical instrument according to a first embodiment of the present invention.

Reference is first made to FIG. 6 showing a configuration of a musical instrument according to a first embodiment of the present invention. The depression of a key in a keyboard as a play input by a player is detected by a keyboard section 11. A velocity of depressing a key, i.e., a velocity of a moving key by an initial touch, is detected by a velocity detector 12. The velocity data (touch data) representative of the detected velocity is transferred to a central processing unit (CPU) 13. The CPU 13 calculates a pitch defined by a depressed key, a volume based on the velocity data corresponding to a velocity of depressed key, and the like. The CPU 13 reads out different tone waveform data from a tone data memory 14 storing tone waveform data, for two sound source lines. On the basis of the two types of tone waveform data as read out, a tone signal generator 15 generates tone waveform data of two types of waveforms for the two sound source lines. The tone signal generator 15 is able to individually set the frequencies of musical tones to be sounded. When detune data is applied from detune setting section 16 to the CPU 13, the tone waveform generator 15 sets different frequencies for the two sound source lines under control of the CPU 13. A velocity parameter setting section 17 applies velocity split point data and touch curve data to the CPU 13. The tone waveform data for the two lines, which are generated by the tone signal generator 15 under control of the CPU 13, are applied to a D/A converter 18 where those items of data are converted into two analog signals $\alpha$ and $\beta$. These analog signals are applied to a mixer 19. In the mixer 19, the analog signals are mixed and amplified. A speaker 2 receives the output signal from the mixer 19 and sounds a detuned musical tone.

Figure 7:
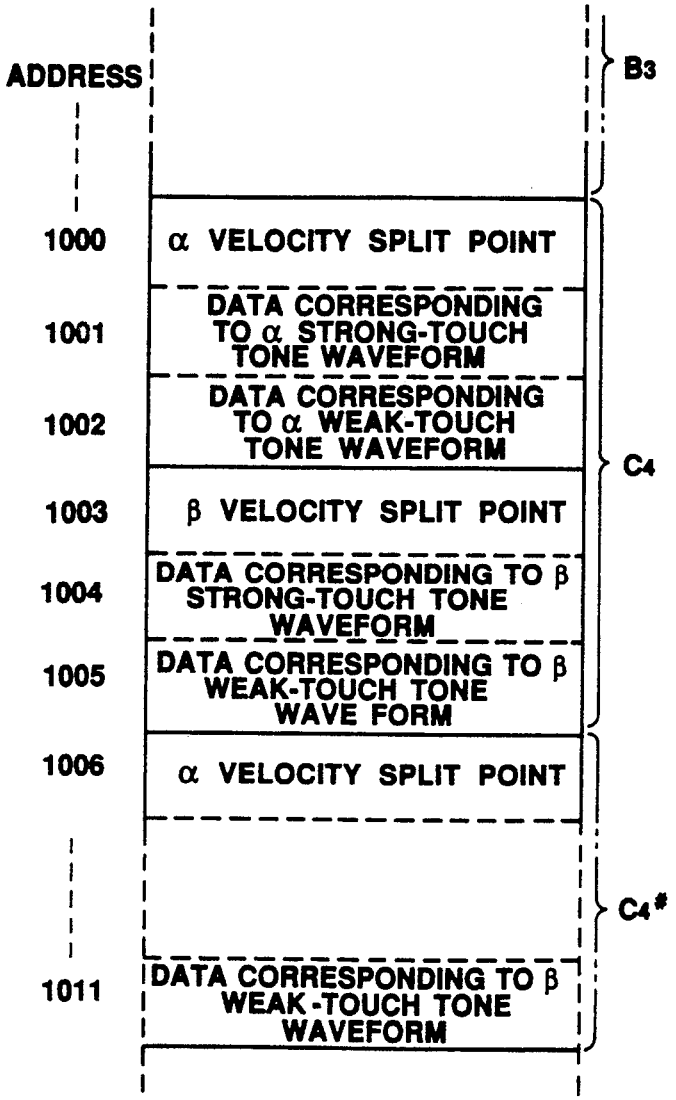
FIG. 7 is a memory map of a tone data memory in the first embodiment of FIG. 6.

FIG. 7 shows a memory map of the tone data memory 14 storing musical tone data. As shown, the data for the line $\alpha$ as one of the sound source lines and the data for the line $\beta$ as the other sound source line are stored into storage locations of the memory 14 which are respectively assigned to individual note names. As the data generated when a key C4 in the keyboard section 1 is depressed, the data of an $\alpha$ velocity split point is stored in the storage location of address 1000. Further, the data of an α strong-touch tone waveform are stored into storage locations of address 1001 (including the start address, end address, loop start address, and velocity curve data in a waveform ROM); the data of an α weak-touch tone waveform, into address 1002; the data of β velocity split point, into address 1003; the data of a β strong-touch tone waveform, into address 10004; the data of a β weak-touch tone waveform, into address 1005. Similarly, the data on the α and β lines for a key C4# are stored into the storage locations of addresses 1006 to 1011.

Figure 8:
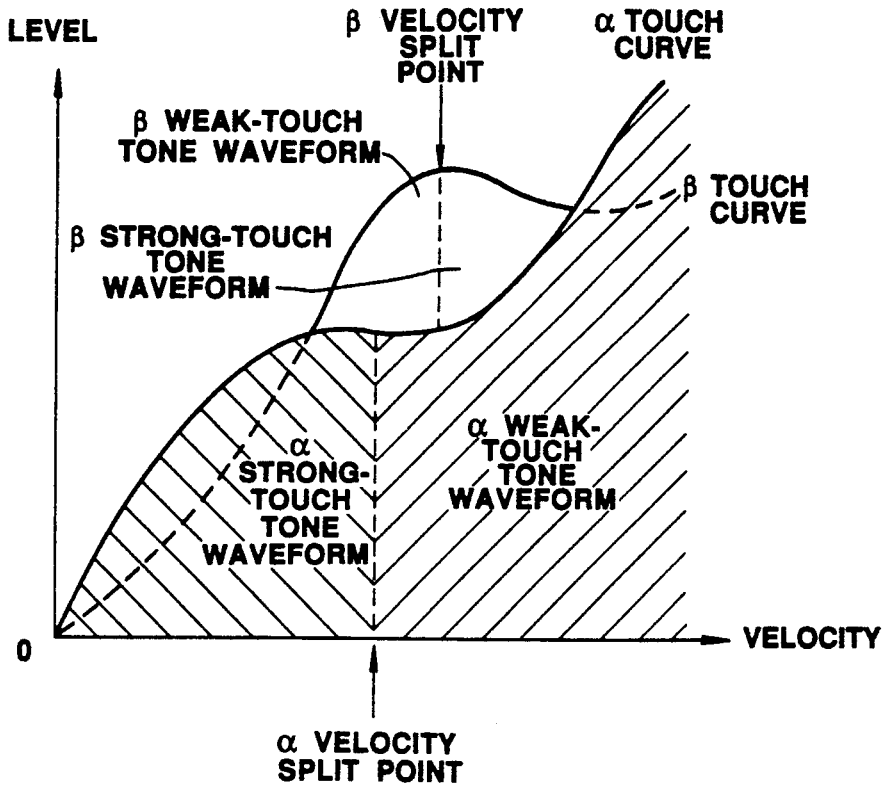
FIG. 8 is a graph showing the waveforms of the touch data of two lines, the graph useful in explaining how to combine the touch data on two sound source lines.

FIG. 8 is a graphical representation of touch curves (velocity split tone waveform graph). In the Figure, the abscissa indicates a velocity as a strength of key depression, and the ordinate, level of α and β tone waveforms that are generated by the tone signal generator 15, for the α and β lines. When the key C4, for example, is depressed, the α line produces, in a low velocity region, a weak tone signal of a certain timbre that varies along an α touch curve as a velocity curve preset by the velocity parameter setting section 17. In a high velocity region where velocities are in excess of an α velocity split point preset by the velocity parameter setting section 17, the α line produces a strong tone signal whose waveform is different from that of the weak tone along the α touch curve.

The β line produces a weak tone signal of a certain timbre along the β touch curve in a low velocity region where velocities are below a β velocity split point that is preset by the velocity parameter setting section 17. When the velocity exceeds the β velocity split point, the β line produces a strong tone signal whose waveform varies along the β touch curve. Thus, in the instant embodiment, two different tone signals are generated by two independent sound source lines, the α line and the β line. Both the tone signals are mixed along the touch curves, and the mixed signal is sounded. The frequencies of the tone signals generated by the sound source lines may be independently changed by the detune data entered from the detune setting section 6, on the basis of the pitch data resulting from the key depression.

The operation of the musical instrument according to the first embodiment of the present invention will be described with reference to FIGS. 7, 8 and 9. The operation follows depression of a key C4.

Figure 9:
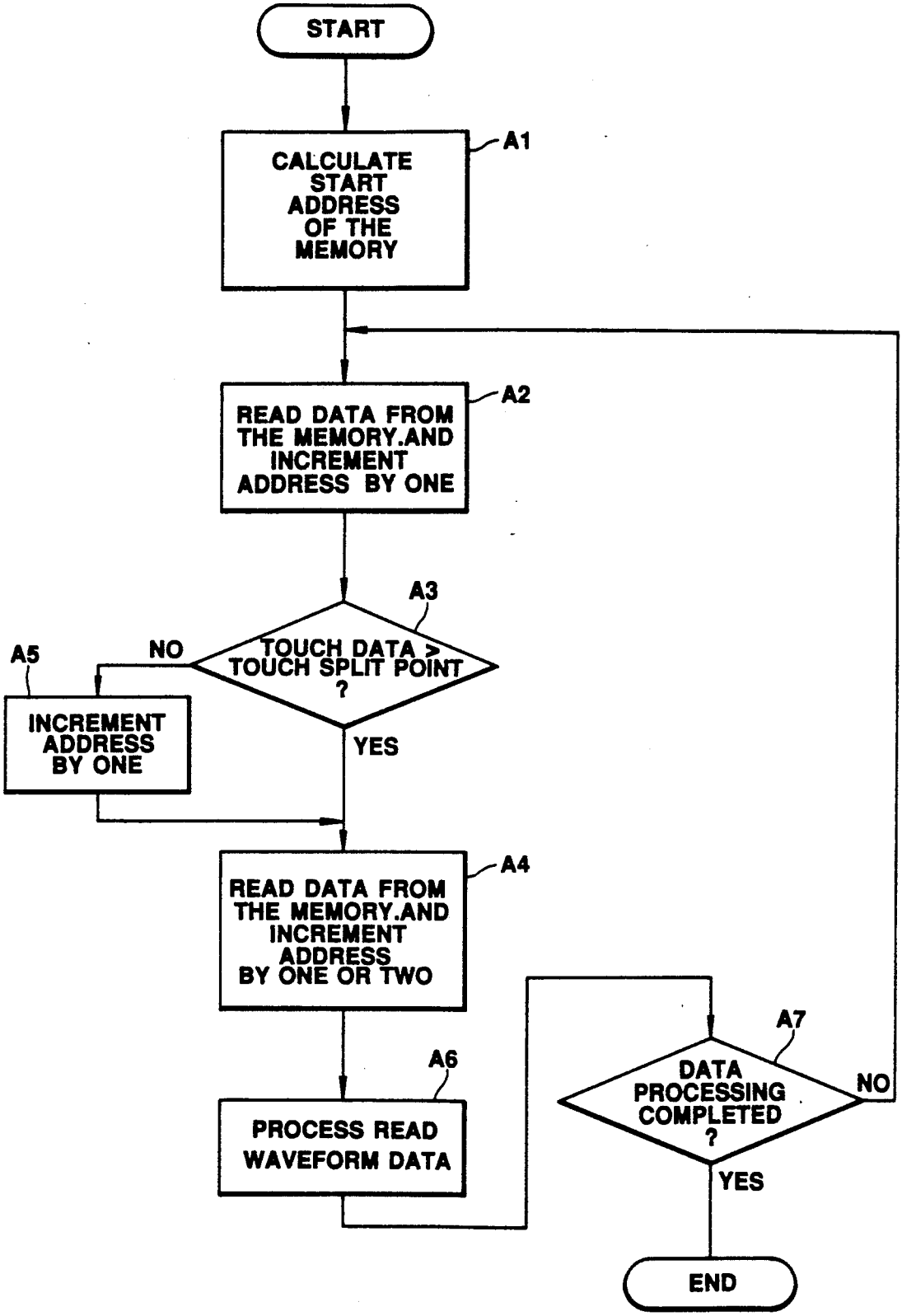
FIG. 9 shows a flowchart for explaining a waveform formation by the musical instrument of the first embodiment.

A flowchart of FIG. 9 shows a subroutine to execute a task by the CPU 13 when a certain key of the keyboard section 11 is depressed. Upon depressing a key, a main flow (not shown) by the CPU 13 is interrupted and that subroutine starts. The CPU 13 fetches a key number corresponding to a note name of the depressed key, and calculates a start address of a storage location of the tone data memory 14 that corresponds to the key number (Step A1). The CPU 13 reads out the data from a storage location of the calculated start address. For example, it reads out the c velocity split point data from the storage location of address 1000 (see FIG. 7). The CPU 13 increments the address by one (+1) (Step A2). The CPU 13 checks whether or not the velocity of the key actually depressed is larger than the α velocity split point just read out (Step A3). If the answer is YES, the CPU 13 reads out the data (start address) of the strong-touch tone waveform stored in the storage location of address 1001. Then, it increments the address by two (+2), in order to read out the data of the β line (Step A4). If the answer is NO, the CPU 13 must read out the data of the α weak-touch tone waveform, since this is the case that the velocity is smaller than the α velocity split point. To this end, the CPU 13 increments the address by one (+1) (Step A5). After reading out the α weak-touch tone waveform data from the storage location of address 1002, the CPU 13 increments the address by one to read out the data for the β line (Step A4).

Succeedingly, the CPU 13 processes the data read out in Step A4, and sends to the tone signal generator 15 a control signal to generate an α line tone signal on the basis of parameters preset by the velocity parameter setting section 17 (Step A6). The CPU 13 checks whether or not the velocity split processings corresponding to the key depression for both the sound source lines, the α line and β line (Step A7). If the answer is YES, the subroutine thus far executed ends. If the answer is NO, this is the case that the β line velocity split processing is not yet completed. Therefore, the CPU 13 returns to Step A2, and executes the tasks from Step A2 to Step A7, to cause the tone signal generator 15 to generate a tone waveform of the β line. In Step A6, to obtain the detune effect, the CPU 13 executes the detune task by staggering the frequencies of the tone waveforms for both the α and the β lines with respect to the frequency of the tone produced by the key C4, and sends a command for frequency control to the tone signal generator 15.

In the first embodiment of the present invention as mentioned above, the present invention is applied to an electronic keyboard instrument with the keyboard section 11. It is evident that if necessary, the present invention is applicable for any type of musical instrument in which touch data can be detected from the play input, such as an electronic string instrument and an electronic percussion instrument.

In the first embodiment, the touch control is based on the initial velocity curve (touch curve) and the initial velocity split point. If necessary, the touch control may be based on the after touch curve and the after touch split point by the after touch.

Further, the mixer 19 and the speaker 20 may be installed outside the main body of the musical instrument. In this case, the main body may be connected to the mixer and the speaker by means of an MIDI (musical instrument digital interface) cable. Additionally, the tone data memory 14 may be substituted by a ROM pack. [2nd Embodiment]

A second embodiment of an electronic musical instrument according to the present invention will be described with reference to FIGS. 10 through 19.

Figure 10:
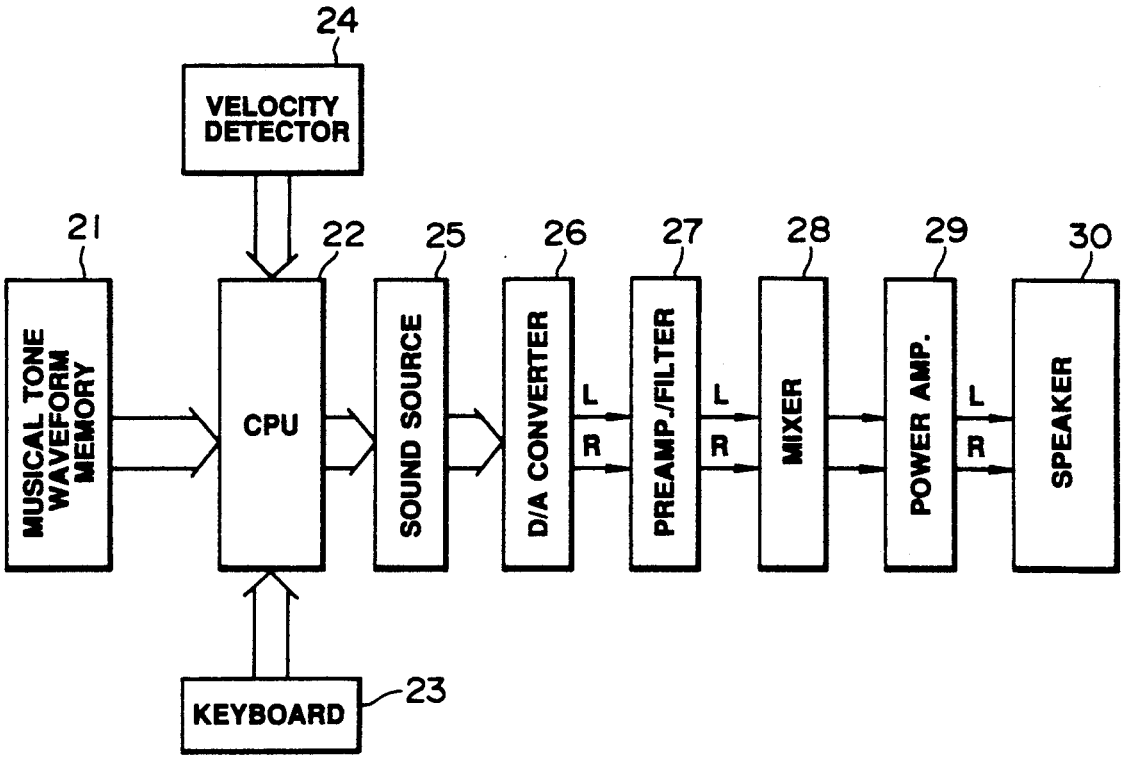
FIG. 10 is a block diagram of an electronic musical instrument according to a second embodiment of the present invention.

FIG. 10 shows a configuration of an electronic musical instrument according to a second embodiment of the present invention. Musical tone waveforms of different types are pulse code modulated and stored in a tone waveform memory 21. A CPU 22 reads out waveform data using key code data generated by depressing keys in a keyboard 23. The CPU 22 fetches velocity data corresponding velocities of depressed keys in the keyboard 23 from a velocity detector 24. The CPU 22 transfers the waveform data that is selected depending on the fetched velocity data, to a sound source 25. The sound source 25 transfers to a D/A converter 26 the tone waveform data whose waveform is configured in accordance with the velocity data using the waveform data from the CPU 22. The D/A converter digitizes the waveform data signal into stereo analog signals of L and R. The analog signals are amplified and filtered out by a preamplifier/filter 27. Then, these stereo analog signals are mixed by a mixer 28, and then amplified by a power amplifier 29. Finally, it is sounded as a desired musical tone by a speaker 30.

Figure 11:
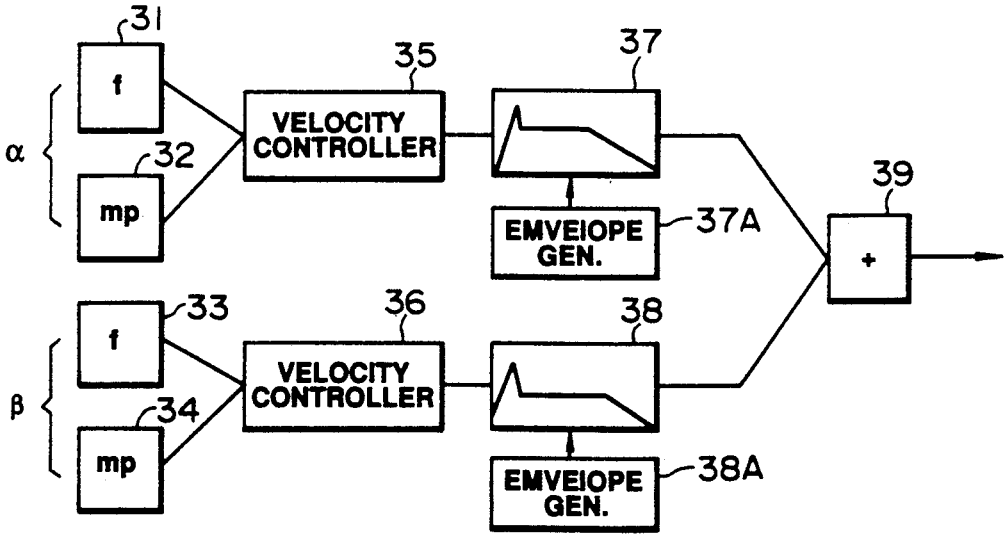
FIG. 11 is a block diagram showing a sound source in the instrument of FIG. 10.

FIG. 11 shows a specific circuit arrangement of the sound source 25 in the FIG. 10 circuit. Four different waveform data are loaded into four DCOs 31 to 34 by the CPU 22. A pair of the DCOs 31 and 32 make up a sound source line $\alpha$, and another pair of the DCOs 33 and 34 make up another sound source line $\beta$. The sound source line $\alpha$ is followed by a velocity controller 35 and an envelope controller 37. Similarly, the sound source line $\beta$ is followed by a velocity controller 36 and an envelope controller 38. The tone signals derived from the sound source lines $\alpha$ and $\beta$ are added together by an adder 39, to form a single tone signal.

It is assumed now that waveform data "f" corresponding to large velocity are set in the DCOs 31 and 33, and that waveform data "mp" corresponding to small velocity are set in the DCOs 32 and 34. The velocity controllers 35 and 36 store respectively touch table data as shown in FIGS. 12A and 12B, in order to level control the waveform data in accordance with the velocity data. The touch table data includes of velocity split point data and a coefficient (e.g., 0 to 255), which changes with increase of the velocity data (e.g., 0 to 127) and is to be multiplied by the waveform data, and corresponds to the touch curve in the first embodiment. Envelopes as shown in FIG. 11 are applied to the envelope controllers 37 and 38, from envelope generators 37A and 38A, respectively. The envelope controllers 37 and 38 respectively apply the envelope characteristics to the waveform data of the sound source lines $\alpha$ and $\beta$ that is level controlled on the basis of the velocity data by level controlling the waveform data with respect to time, viz., over a time elapse starting at a start point of a key depression in the keyboard section 23. Subsequently, both the waveform data are added together by an adder 39.

According to the touch table data shown in FIGS. 12A and 12B, as the velocity data gradually increases, the tone waveform output from the sound source line $\alpha$ changes from the waveform data "mp" to the waveform data "f" at the velocity split point. The same thing is true for the waveform data from the sound source line $\beta$. Accordingly, the adder 29, i.e., the sound source 15, produces a tone waveform characterized in that the waveform data changes from the data mp to data "f" at the split point, as shown in FIG. 12C. Thus, the DCOs are switched at the preset velocity split point by the velocity data.

According to the touch table data shown in FIGS. 13A to 13C, when the velocity data increases from 0, the adder 39 produces the waveform data (mp+mp). At the first split point (of the sound source line $\beta$), the adder produces waveform data (mp+mf). Then, at the next split point, the adder waveform data (f+mf). Thus, as the velocity data increases, the waveform data changes in the order of (mp+mp), (mp+mf) and (f+mf).

According to the touch table data shown in FIGS. 14A to 14C, when the velocity data increases from 0, the adder 39 produces the waveform data "p" of only the sound source line $\alpha$. When the velocity data further increase and passes a first split point, the adder produces the waveform data "mp". Then, when the velocity data passes a second split point, the sound source line $\alpha$ is switched from the sound source line $\beta$ and the adder produces the waveform data "mf" of the sound source line. When the velocity data further grows, the waveform form data "f" is produced.

FIG. 15 shows a PCM waveform as an example of the tone waveforms stored in the tone waveform memory 21. The amplitude of the PCM waveform varies with respect to time, as shown. The PCM waveform is read out from the memory in the following way. The CPU 22 reads out the PCM waveform from the storage location of a start address in the memory area of the memory 21 where the waveform data is stored. At this point, the waveform rises. Subsequently, the CPU 22 sequentially reads out the waveform data while updating the address. After the data is read out from the storage location of the loop end address, the CPU 22 repeatedly reads out the waveform data between the loop start address and the loop end address.

Figure 16:
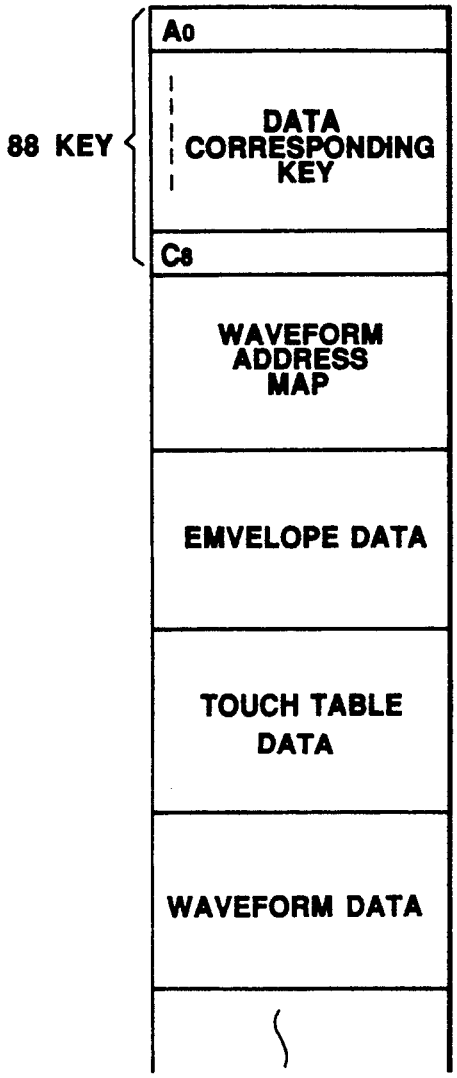
FIG. 16 shows a memory format of data stored in the waveform memory.

FIG. 16 shows a memory format various data as timbre parameters stored in a memory section of the musical instrument, which includes the tone waveform memory 11. The memory format is made up of the data A0 to C8 of to the keys, waveform address map, envelope data, touch table data, waveform data including the data of actual tone waveforms. The data A0 to C8 specify the waveform data and an envelope that are to be selected when one of the 88 keys corresponding to note names A0 to C8 in the keyboard section 23. The waveform address map stores the start address, loop end address, and the like of an actual tone waveform as shown in FIG. 15. The envelope data are used by the envelope controllers 37 and 38. The touch table data, which are as shown in FIGS. 12 to 14, are set in the velocity controllers 35 and 36.

Figure 17:
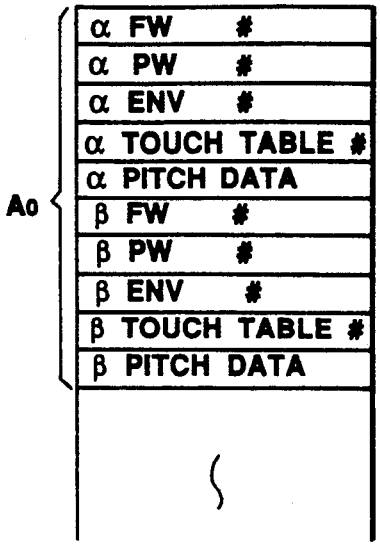
FIG. 17 shows a memory format of various data as timbre parameters stored in the tone waveform memory.

FIG. 17 shows a memory format of the data groups for the sound source line c and the sound source line $\beta$. The data groups constitute an example of the data of the key A0. The data groups contain FW# and PW# indicating waveform numbers for the pairs of DCOs 31 and 32, and 33 and 34, which belong to the sound sources $\alpha$ and $\beta$, respectively, ENV# representing the numbers of the envelopes, touch table # representing the number of the touch table, and pitch data. Here symbol # represents indefinite data indicating a number. As seen, the waveform data $\alpha$FW# for the DCO 31 is stored in the memory location of the start address in the memory format of FIG. 17. In the memory location of the next address, the waveform data $\alpha$PW# for DCO 22 is stored. The memory locations of the succeeding three addresses store the envelope data $\alpha$ENV# to be set in the sound source line $\alpha$, the number for setting touch table data, and the pitch data corresponding to the key code number of the key A0, that is for specifying a velocity to read out the waveform data. The memory locations of the next five addresses store the same types of data for the sound source line $\beta$ as those of the data for the sound source line $\beta$; $\beta$FW#, $\beta$PW#, $\beta$ENV#, $\beta$ touch table #, and pitch data.

Figure 18:
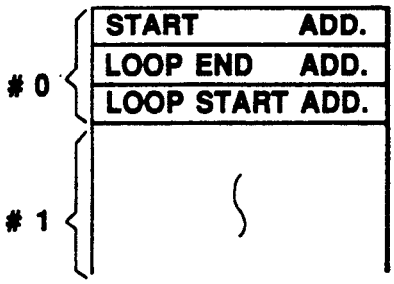
FIG. 18 shows a memory format of waveform addresses, which is also stored in the tone waveform memory.

FIG. 18 shows an address map in which a start address, loop end address, and loop start address are laid out for each number (type) of the waveform data, as shown.

Figure 19:
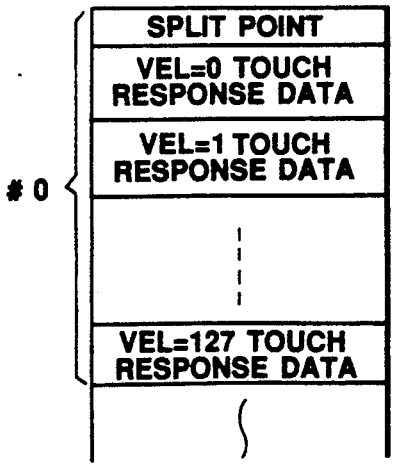
FIG. 19 shows a memory format of touch table data.

FIG. 19 shows a format of the touch table data. As shown, velocity split point (value of the velocity data to be split), and touch response data corresponding to the velocity data of 128 stages from 0 to 127, viz., the data defining a velocity curve are laid out for each type (number) of the touch table.

The operation of the musical instrument according to the second embodiment will be described.

Let us assume now that a key A0 of a note name A0 in the keyboard section 23 is depressed. The CPU 22 reads a key code of its pitch A0. Using the key code as the address, the CPU 22 reads out of the tone waveform memory 21, the key data (FIG. 17), the touch table data (FIG. 19), and additionally envelope data and pitch data. The velocity detector 24 detects a velocity of the key depression, and generates velocity data. The CPU 22 reads out the velocity split point data, and compares this data with the velocity data generated by the velocity detector. On the basis of the comparison result, the CPU 22 decides which waveform data is selected, the waveform data from the DCO 31 or that from the DCO 32, that is, the αFW# data or the βPW# shown in FIG. 17. Then, it reads out the selected waveform data at a rate of speed depending on the pitch data. The CPU 22 applies similar operations to the sound source line β, and reads out desired waveform data.

The CPU 22 reads out the envelope data as is stored in connection with the key code of the key A0 as shown in FIG. 16, and sets the data in the envelope controllers 37 and 38. The controller 37 generates an actual envelope using the touch response data corresponding to the velocity data, and apply the actual envelope to the waveform data coming from the velocity controller 35. The other controller 38 operates in a similar way.

Through the above sequence of operations, the waveform data, velocity curve, and velocity split point as shown in FIGS. 12A through 12C are set in the sound source lines α and β of the musical instrument. The result is to obtain a musical tone changing between two different timbres in accordance with the velocity data, and to have a detune effect resulting from a pitch difference between the waveform data on the two sound source lines. When the data as shown in FIGS. 13A to 13C are set, three velocity regions are generated. In each velocity region, the mixing ratio of the musical tone signals from the sound source lines α and β changes, viz., a timbre changes. Accordingly, the musical tone generated has a variety of timbres. When the data as shown in FIGS. 14A to 14C are set, four velocity regions are generated. An additional number of waveforms, p, mp, mf, and f, are used. Accordingly, the resultant musical tone has a further variety of timbres.

It is evident that the number of the DCOs and that of the sound source lines are not limited to four and two which are the number of those in the second embodiment. The number of velocity split points may be increased, if necessary. The increased number of the split points further diversifies the timber of the generated tone. The velocity curve data and the velocity split point data may be preset in a memory or set by users. For example, in the musical instrument of FIG. 6, a frequency shift may be adjusted by the knob **16*a* of the detune setting section 16. The velocity curve data and the split point data may be set by the ten key 17*a* of the velocity parameter setting section 17**. For the touch control, the initial touch data concerning a velocity of key depression may be substituted by the after touch data concerning a change in the force maintaining a key depression.

The present invention is applicable not only for keyed instruments, but also for many electronic instruments, such as stringed instruments, blowing instruments, and sound source modules.

What is claimed is:

1. An electronic musical instrument, comprising:

waveform generating means having a plurality of lines, each generating one of a plurality of tone waveforms in response to a single input performance data;

touch response curve setting means for setting, for each of said lines, a touch response curve representing a relationship between a degree of touch data and a waveform level;

touch split point setting means for setting, for each of said lines, a point to divide the touch response curve into touch response curves having respective ranges;

waveform assigning means coupled to said touch split point setting means, for assigning a selected one of said plurality of tone waveforms to each range set by said touch split point setting means, and for determining a tone waveform to be generated by each of said lines in accordance with an input touch data;

waveform level control means coupled to said waveform generating means and to said waveform assigning means, for controlling a waveform level of the other waveform to be generated by each line according to the touch response curve set for each line, in response to an input performance data; and detune setting means for staggering the frequencies of the tone waveforms generated from said plurality of lines.

2. The musical instrument according to claim 1, in which at least one of the tone waveforms assigned for said each line, the touch response data set for said each line, the touch split point set for said each line, and the difference between the reference frequencies of said respective lines is prefixed.

3. The musical instrument according to claim 1, in which at least one of the tone waveforms assigned for said each line, the touch response data set for said each line, the touch split point set for said each line, and the difference between, the reference frequencies of said respective lines is appropriately set.

4. The musical instrument according to claim 1, in which said waveform generating means includes waveform memory means storing amplitudes of musical tones.

5. An electronic musical instrument, comprising:

waveform generating means having a plurality of lines, each generating one of a plurality of tone waveforms in response to a single input performance data;

touch response curve setting means for setting, for each of said lines, a touch response curve representing a relationship between a degree of touch data and a waveform level;

touch split point setting means for setting, for each of said lines, a point to divide the touch response curve into touch response curves having respective ranges;

waveform assigning means coupled to said touch split point setting means, for assigning a selected one of said plurality of tone waveforms to each range set by said touch split point setting means, and for determining a tone waveform to be generated by each of said lines in accordance with an input touch data;

waveform level control means coupled to said waveform generating means and to said waveform assigning means, for controlling a waveform level of the tone waveform to be generated by each line according to the touch response curve set for each line, in response to an input performance data;

envelope control means for controlling envelope of the tone waveforms of said lines derived from said waveform level control means; and combining means for combining a plurality of musical tone waveforms obtained by said envelope control means.

6. The musical instrument according to claim 5, in which at least one of the tone waveforms assigned for said each line, the touch response data set for said each line, the touch split point set for said each line, and the difference between the reference frequencies of said respective lines is prefixed.

7. The musical instrument according to claim 5, in which at least one of the tone waveforms assigned for said each line, the touch response data set for said each line, the touch split point set for said each line, and the difference between the reference frequencies of said respective lines is appropriately set.

8. The musical insturment according to claim 5, in which said waveform generating means includes waveform memory means storing amplitudes of musical tones.

9. An electronic musical instrument, comprising:

waveform generating means having a plurality of lines, each generating one of a plurality of tone waveforms in response to a single input performance data;

touch response curve setting means for setting, for each of said lines, a touch response curve representing a relationship between a degree of touch data and a waveform level;

touch split point setting means for setting, for each of said lines, a point to divide the touch response curve into touch response curves having respective ranges;

waveform assigning means coupled to said touch split point setting means, for assigning a selected one of said plurality of tone waveforms to each range set by said touch split point setting means, and for determining a tone waveform to be generated by each of said lines in accordance with an input touch data; and waveform level control means coupled to said waveform generating means and to said waveform assigning means, for controlling a waveform level of the tone waveform to be generated by each line according to the touch response curve set for each line, in response to an input performance data.

10. The musical instrument according to claim 9, in which at least one of the tone waveforms assigned for said each line, the types of the touch curve set for said each line, the touch split point set for said each line, and the difference between the reference frequencies of said respective lines is prefixed.

11. The musical instrument according to claim 9, in which at least one of the tone waveforms assigned for said each line, the types of the touch curve set for said each line, the touch split point set for said each line, and the difference between, the reference frequencies of said respective lines is appropriately set.

12. The musical instrument according to claim 9, in which said waveform generating means includes waveform memory means storing amplitudes of musical tones.

13. An electronic musical instrument, comprising:

waveform generating means for generating a plurality of musical tone waveforms simultaneously in order to generate a plurality of musical tones in response to a single input performance data;

touch response curve setting means for setting, for each of said musical tones, a touch response curve representing a relationship between a degree of touch data and a waveform level;

touch split point setting means for setting, for each of said musical tones, a point to divide the touch response curve into touch response curves having respective ranges;

waveform assigning means coupled to said touch split point setting means, for assigning a selected one of said plurality of musical tone waveforms to each range set by said touch split point setting means, and for determining a musical tone waveform to be generated as each of said musical tones in accordance with an input touch data; and waveform level control means coupled to said waveform generating means and to said waveform assigning means, for controlling a waveform level of the musical tone waveform to be generated as each musical tone according to the touch response curve set for each musical tone, in response to an input performance data.

14. The musical instrument according to claim 13, in which at least one of the musical tone waveforms assigned for said musical tone, the touch response data set for said each musical tone, and the touch split point set for each of said musical tones, is prefixed.

15. The musical instrument according to claim 13, in which at least one of the musical tone waveforms assigned for said each musical tone, the touch response data set for said each musical tone, and the touch split point set for said each musical tone is appropriately set.

* * * * *